United States Patent [19]

Martin

[11] 4,439,678

[45] Mar. 27, 1984

[54] WELLBORE TREATMENT

[75] Inventor: F. Glenn Martin, Irving, Tex.

[73] Assignee: Atlantic Richfield Company, Los Angeles, Calif.

[21] Appl. No.: 330,068

[22] Filed: Dec. 14, 1981

[51] Int. Cl.[3] ..... G01V 5/00

[52] U.S. Cl. ..... 250/260

[58] Field of Search ..... 250/256, 259, 260

[56] References Cited

U.S. PATENT DOCUMENTS 3,251,993 5/1966 Bader et al. ..... 250/260

3,503,447 3/1970 Hamby, Jr. ..... 250/260

*Primary Examiner*—Janice A. Howell

*Attorney, Agent, or Firm*—Roderick W. MacDonald

[57] ABSTRACT

A method for determining the success of a multiple perforation operation by determining whether all perforations are open comprising providing a fluid loss control composition which carries one or more materials designed to form a filter cake on the wellbore wall, at least one of the filter cake forming materials being radioactively tagged, injecting the fluid loss control composition into the wellbore and into the perforations to build up a filter cake on the wellbore wall behind the perforations and running a nuclear log survey in the wellbore to determine which of the perforations were sufficiently open to the wellbore wall to establish a filter cake buildup thereon.

4 Claims, 2 Drawing Figures

WELLBORE TREATMENT

BACKGROUND OF THE INVENTION

Heretofore, radioactive solutions of iodine 131 have been employed in a wellbore, followed by an overflush of a non-radioactive liquid to get the radioactive liquid out of the wellbore before nuclear logging. Thereafter, a nuclear log survey was run to determine where the liquid went when it left the wellbore and entered the surrounding formation. A problem with liquid radioactive tracer surveys has been that if the overflush is too large, the radioactive liquid can be washed so far away from the wellbore that the nuclear log survey cannot detect the liquid since it has been flushed beyond the range of the logging tool.

Also, heretofore, propping agents used in fracturing treatments have been radioactively tagged to determine where the propping agent went. The propping agents used are normally large, i.e., greater than 40 mesh (U.S. Sieve Series) in order to prop the fracture open as far as possible.

SUMMARY OF THE INVENTION

Usually, a wellbore, after drilling, is lined with cement and the cement lining is lined with steel casing pipe. The casing and cement are then perforated at one or more locations to establish communication with the interior of the wellbore and one or more geologic formations adjacent the perforations so that oil and gas can be produced through the perforations into the wellbore or fluid from the earth's surface can be pumped down into the wellbore through the perforations and into the formation as in an injection well for a water flood unit. Sometimes, the perforation operation is not totally successful in that a particular set of perforations is not open all the way to the formation, whereas other sets of perforations in the wellbore were successful in that they opened communication between the wellbore and a desirable formation. It is highly desirable to know precisely where the unopened perforations are so that the re-perforation operation can be directed solely to that area of the wellbore, rather than running the entire perforation operation over again, which is not necessary in the areas where the perforations were completely open to start with.

According to this invention there is provided a method for determining the success of a multiple perforation operation in a wellbore wherein at least two separate geologic formations were to be put into communication with the wellbore by way of at least two sets of perforations. This method determines whether all sets of perforations are open to the formation or if one or more sets is not open. The method of this invention comprises providing a fluid loss control composition which carries one or more materials designed to form a filter cake on the wellbore wall, at least one of the filter cake forming materials being radioactively tagged, injecting the fluid loss control composition into the wellbore and into the perforations to build up a filter cake on the wellbore behind each set of perforations, and running a nuclear log survey in the wellbore to determine which of the sets of perforations were sufficiently open to the wellbore wall to establish a filter cake buildup on the wellbore wall. This way, if a filter cake is not detected whose perforations should have been established, it is known that the perforations are not open and re-perforating in that particular area is necessary. In all other areas which show a filter cake buildup, it is known that the perforations are open and in communication with the formation so that further perforating in those areas is not necessary.

Accordingly, it is an object of this invention to provide a new and improved method for determining the success of a multiple perforation operation in a wellbore. Other aspects, objects and advantages of this invention will be apparent to those skilled in the art from this disclosure and the appended claims.

DETAILED DESCRIPTION OF THE INVENTION

Figure 1:
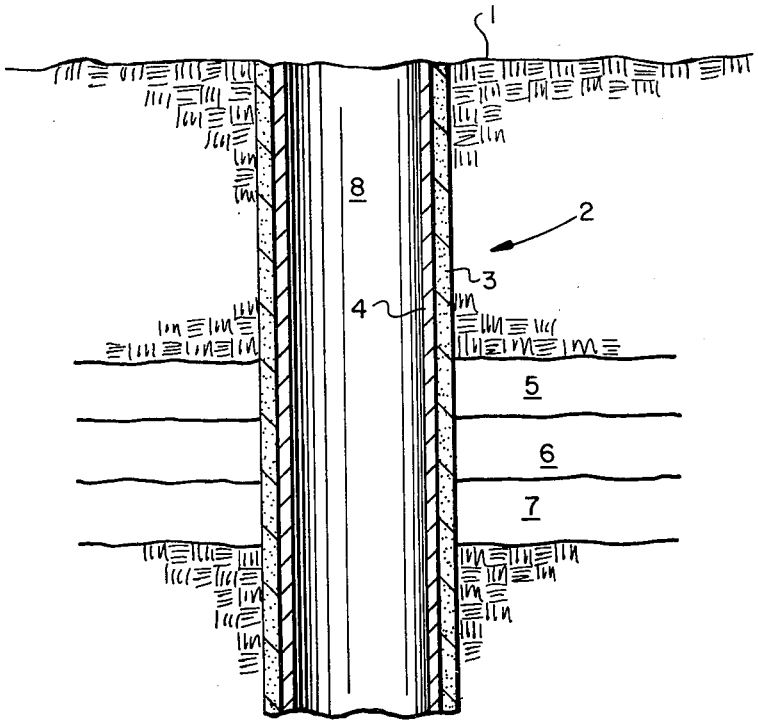
FIG. 1 shows a vertical cross-section of a wellbore in the earth in which the method of this invention can be practiced.

FIG. 1 shows the earth's surface 1 with wellbore 2 extending downwardly therein through a plurality of geological formations 5 through 7, inclusive. Wellbore 2 is lined with cement 3 and steel casing 4 in a conventional manner, thereby closing interior 8 of wellbore 2 from communication with any of formations 5 through 7. Formations 5 and 7 are, in this particular instance, oil and gas producing formations, and, therefore, communication between wellbore interior 8 and these two formations is desired. This is accomplished by a conventional perforating operation wherein a plurality of apertures are formed in casing 4 and lining 3 adjacent both formations 5 and 7 so that communication between formations 5 and 7 and interior 8 is established through those perforations to allow oil and gas to flow into interior 8 for pumping or other recovery at the earth's surface 1.

Figure 2:
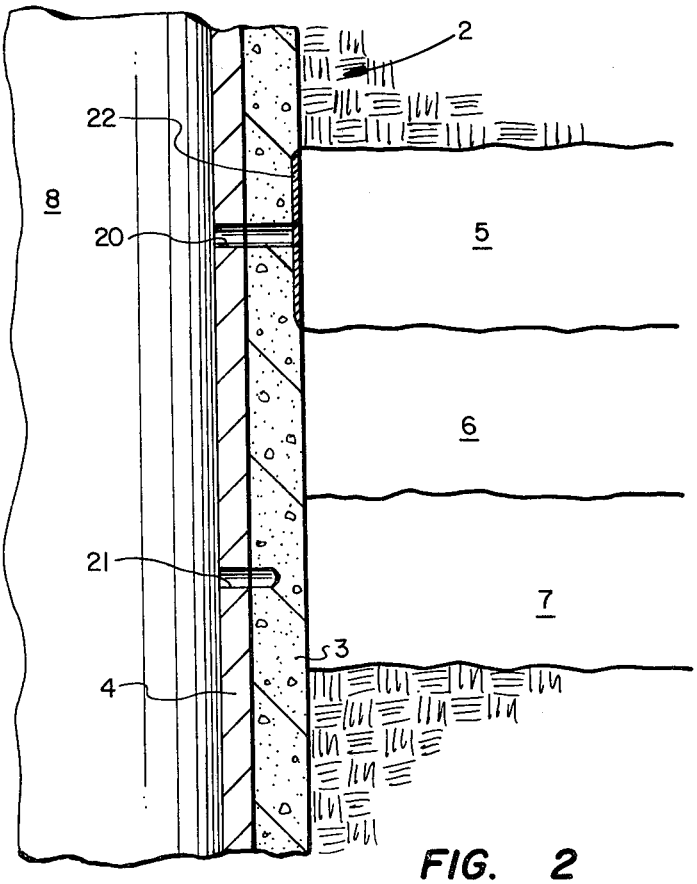
FIG. 2 shows an enlarged, vertical view of a section of the wellbore of FIG. 1, including two sets of perforations to two desirable geologic formations.

FIG. 2 shows an enlarged section of the right half of wellbore 2 of FIG. 1, which section includes formations 5 through 7. FIG. 2 shows perforation 20 which represents a plurality of perforations in the area of zone 5 which extend completely through casing 4 and cement 3 so that good communication is established between formation 5 and interior 8. FIG. 2 also shows unsuccessful perforations 21 in the area of formation 7, in that perforation 21 does not extend all the way through to formation 7 from interior 8 and communication between formation 7 and interior 8 is not established.

By the method of this invention, a fluid loss control composition is prepared which carries one or more materials designed to form a filter cake on the wall of the wellbore at each of formations 5 and 7, at least one of the filter cake forming materials being radioactively tagged. The fluid loss control composition is then injected into interior 8 from earth's surface 1 to flow through perforations 20 and 21 to formations 5 and 7 and build up a filter cake on the wellbore wall, for example, filter cake 22 adjacent formation 5. If perforations 21 were open, as are perforations 20, a similar filter cake would build up on the wellbore wall adjacent formation 7. However, in the case of FIG. 2, perforations 21 are not open and no filter cake forms since open communication has not been established with formation 7.

Thereafter, when a nuclear log survey is run in interior 8, it can be determined that perforations 20 are open by detection of radioactive filter cake 22, and that perforations 21 are not open because no filter cake is detected. A reperforation operation is then carried out in wellbore 2 directed only to those specific areas, such as formation 7, where the nuclear log indicated no filter cake buildup occurred. This is in lieu of re-perforating all zones, including those that were initially successfully perforated, e.g., formation 5.

The filter cake forming material is preferably not greater than 100 mesh (U.S. Sieve Series) and, still more preferably, contains substantially more than 50% by weight of solid particles smaller than 270 mesh (U.S. Sieve Series). The filter cake forming material can be subdivided solids such as silica and calcium carbonate, although other suitable solids will be obvious to those skilled in the art, once apprised of the teaching of this invention. Though an overflush may be employed to displace radioactive materials from the wellbore, there is no risk of washing the radioactive material out into formation 5 so far that a logging tool could not detect it as with liquid iodine solutions, because the radioactive filter cake is designed to stay in place even with a substantial flow of liquid thereby.

This invention can employ conventional fluid loss control compositions which are designed to form a filter cake on a wellbore wall. One or more of the materials in the fluid loss control composition, however, is deliberately tagged with any radioactive material with a suitable half-life, such as iridium 192, scandium 46, or iodine 131, in a conventional manner known in the art, for example, as is currently applied to the larger propping agents.

The fluid loss control composition is then employed in fluid such as water, oil, acid, or the like, and displaced into the wellbore and perforations in a conventional pumping manner. Suitable fluid loss control compositions and how they are made and displaced into a wellbore are well known and fully disclosed in U.S. Pat. Nos. 3,163,219; 3,164,208; and 3,228,469. In addition, U.S. Pat. No. 3,164,208 discloses fracturing processes including the use of silica propping agents.

Any conventional nuclear log survey technique can be employed to detect a radioactive filter cake on the formations in the wellbore. Such radioactive surveys have been carried out for some time to detect radioactively tagged propping agents, so further description of this type of survey is not necessary to inform those skilled in the art. It should be emphasized here that, although the radioactive tagging or propping agents has been practiced, this is not suggestive of determining the success of multiple perforation operations using radioactively tagged fluid loss control agents for the formation of a filter cake on those formations where the perforation operation was successful.

EXAMPLE

A fluid loss control fluid is prepared by gelling 2,000 gallons of water with 50 pounds of cellulose polymer and adding 50 pounds of silica flour tagged in a conventional manner with 10 millicuries of iridium 192. This concentration of a soluble cellulose polymer produces enough viscosity to suspend the silica flour particles but does not form so impermeable a filter cake that fluid cannot be displaced through it. The fluid is spotted opposite all sets of perforations with the aid of a coiled tubing workover pipe string. The fluid loss control fluid is then displaced from the wellbore into the formation or formations through those perforations which are open and effective at an injection rate of 2 to 4 barrels per minute. A coiled tubing string is then run to a point well below the lowest perforation and any fluid loss control fluid still remaining in the wellbore is circulated out of the well with water.

A conventional gamma ray logging tool is then run to detect areas with increased radioactivity, based on a comparison with a base gamma ray log run just prior to the injection of the radioactive fluid loss control fluid. Radioactivity will be high where open perforations exist and will be low, or at about the same level as the base log, where perforation attempts have not effectively established communication with a permeable formation behind the casing pipe and cement liner. Based on this survey, any required remedial operations such as reperforating can be directed to the specific intervals where radioactivity deficiencies are noted.

Reasonable variations and modifications are possible within the scope of this disclosure without departing from the spirit and scope of this invention.

The embodiments of the invention in which an exclusive property or privilege is claimed are defined as follows:

1. A method for determining the success of a multiple perforation operation in a wellbore wherein at least two geologic formations were to be put into fluid communication with said wellbore by way of at least two sets of perforations, wherein said method locates perforations that did not establish such communication and therefore require reperforating, said method comprising providing a fluid loss control composition which carries one or more materials designed to form a filter cake on said wellbore wall, at least one of said filter cake forming materials being radioactively tagged, injecting said fluid loss control composition into said wellbore and into said perforations to build up a filter cake on the wellbore wall behind each set of perforations, and running a nuclear log survey in said wellbore to determine which of said sets of perforations were sufficiently open to establish a filter cake buildup on the wall of the wellbore and which of said sets of perforations were not sufficiently open to establish a filter cake buildup and therefor require reperforating.

2. The method according to claim 1 wherein said radioactively tagged filter cake forming material in a subdivided solid wherein said solid is smaller than 100 mesh.

3. The method according to claim 2 wherein said solid is at least one of silica and calcium carbonate.

4. The method according to claim 1 wherein at least one filter cake forming material is tagged with one of iridium 192, scandium 46, or iodine 131.

* * * * *